US011078062B2

(12) United States Patent
Andriolo et al.

(10) Patent No.: US 11,078,062 B2
(45) Date of Patent: Aug. 3, 2021

(54) BIDIRECTIONALLY EXTENSIBLE SIDE-SHIFTING LAYER-PICKING LOAD CLAMP ASSEMBLY

(71) Applicant: Cascade Corporation, Fairview, OR (US)

(72) Inventors: Francesco Andriolo, San Martino Buon Albergo (IT); Roberto Mazzoleni, Colognola ai Colli (IT)

(73) Assignee: Cascade Corpoation, Fairview, OR (US)

( * ) Notice: Subject to any disclaimer, the term of this patent is extended or adjusted under 35 U.S.C. 154(b) by 0 days.

(21) Appl. No.: 15/653,926

(22) Filed: Jul. 19, 2017

(65) Prior Publication Data

US 2019/0023547 A1 Jan. 24, 2019

(51) Int. Cl.

| | |
|---|---|
| ***B66F 9/14*** | (2006.01) |
| ***B66F 9/18*** | (2006.01) |
| ***B66F 9/19*** | (2006.01) |

(52) U.S. Cl.

CPC ..... *B66F 9/147* (2013.01); *B66F 9/183* (2013.01); *B66F 9/188* (2013.01); *B66F 9/19* (2013.01)

(58) Field of Classification Search

CPC ..... B66F 9/147; B66F 9/183

See application file for complete search history.

(56) References Cited

U.S. PATENT DOCUMENTS

| | | | | |
|---|---|---|---|---|
| 2,665,022 | A | 1/1954 | Dunham | |
| 3,549,192 | A | 12/1970 | Cassady | |
| 3,715,046 | A | 2/1973 | Marklund | |
| 3,796,332 | A | 3/1974 | Kawamura | |
| 4,252,496 | A | 2/1981 | Williams | |
| 4,279,564 | A | 7/1981 | Weinert | |
| 4,303,269 | A | 12/1981 | Faughnan | |
| 4,456,293 | A | 6/1984 | Panissidi | |
| 4,603,896 | A | 8/1986 | Vasseur et al. | |
| 4,636,131 | A | 1/1987 | Sinclair | |
| 5,076,751 | A | 12/1991 | Kafka | |
| 5,161,934 | A | 11/1992 | Richardson | |
| 5,253,974 | A | 10/1993 | Williams | |
| 5,516,255 | A | 5/1996 | Tygard | |
| 6,003,917 | A | 12/1999 | Tygard | |
| 6,135,704 | A * | 10/2000 | Seaberg | B66F 9/183 294/119.1 |
| 6,477,964 | B1 | 11/2002 | Tygard | |
| 7,011,487 | B2 | 3/2006 | Kafka et al. | |
| 7,195,105 | B2 | 3/2007 | Tygard | |
| 7,537,427 | B2 | 5/2009 | Tygard | |

(Continued)

OTHER PUBLICATIONS

United States Patent and Trademark Office, International Search Report and Written Opinion for International Application No. PCT/US2017/052710, dated Dec. 14, 2017, 8 pages.

*Primary Examiner* — Jonathan Snelting

(74) *Attorney, Agent, or Firm* — Chernoff, Vilhauer, McClung & Stenzel, LLP

(57) ABSTRACT

A layer-picking load-clamping and lifting assembly for mounting on a lift truck is capable of bidirectionally side-shifting a load-clamping assembly substantially straightly along a side-shifting length. The load clamping assembly has opposed clamp arms each selectively movable along a direction parallel to the side-shifting length so as to be selectively separable in a plurality of different possible relationships.

4 Claims, 4 Drawing Sheets

(56) References Cited

U.S. PATENT DOCUMENTS

| | | | | |
|---|---|---|---|---|
| 7,794,193 | B2 * | 9/2010 | Schonauer | B66F 9/147 414/666 |
| 7,841,822 | B2 | 11/2010 | Tygard | |
| 7,993,094 | B2 | 8/2011 | Tygard | |
| 8,083,459 | B2 | 12/2011 | Tygard | |
| 8,142,131 | B2 | 3/2012 | Tygard | |
| 8,814,238 | B2 | 8/2014 | Tygard | |
| 9,604,830 | B2 | 3/2017 | Tygard | |
| 2003/0185660 | A1 | 10/2003 | Kafka et al. | |
| 2003/0233184 | A1 | 12/2003 | Roncari | |
| 2004/0115035 | A1 | 6/2004 | Tygard | |
| 2009/0281655 | A1 | 11/2009 | McKernan et al. | |
| 2017/0369295 | A1 * | 12/2017 | Tygard | B66C 1/44 |

* cited by examiner

BIDIRECTIONALLY EXTENSIBLE SIDE-SHIFTING LAYER-PICKING LOAD CLAMP ASSEMBLY

BACKGROUND OF THE INVENTION

Layer-picking clamp assemblies of various different types have previously been used in the load-handling industry to reach sideways from a lift truck or other load-handling machine so as to position a downwardly extending load-engaging clamp into alignment over a load, selectively lower the clamp so as to surround an upper portion of the load laterally, and then clamp and lift the upper portion vertically to separate it from a lower portion of the load.

Previous types of such layer-picking clamp assemblies, exemplified in U.S. Pat. Nos. 6,135,704 and 7,841,822, have utilized a laterally rotational boom assembly to rotate a suspended, downwardly-directed load-engaging clamp into a position horizontally aligned above a layered load located remotely from the lift truck. However, the laterally rotational boom assemblies of both of these examples limit the ability of the clamp assembly to transfer the load from the boom to the forks of a counterbalanced lift truck upon which the boom is mounted without tipping the lift truck, unless the weight of the load is greatly limited below the normal capacity of the lift truck. Rotation of such a boom assembly when loaded also creates a large moment of inertia which further limits the lift truck's counterbalanced load carrying capacity.

Another previous type of layer-picking clamp assembly, exemplified in U.S. Pat. No. 5,516,255, utilizes a non-rotational, laterally extensible boom assembly to position a load-engaging clamp above a layered load. However, such boom assembly likewise prevents the ability of the clamp assembly to transfer a load from the boom to the forks of the counterbalanced lift truck upon which the boom is mounted. Such boom assembly also disadvantageously requires a large forwardly-positioned counterweight on the opposite side of the lift truck which limits the counterbalanced forward tipping stability of the lift truck.

A need therefore exists for an improved structure which minimizes the foregoing drawbacks of existing layer-picking load clamping assemblies.

DETAILED DESCRIPTION OF PREFERRED EMBODIMENTS

Figure 1:
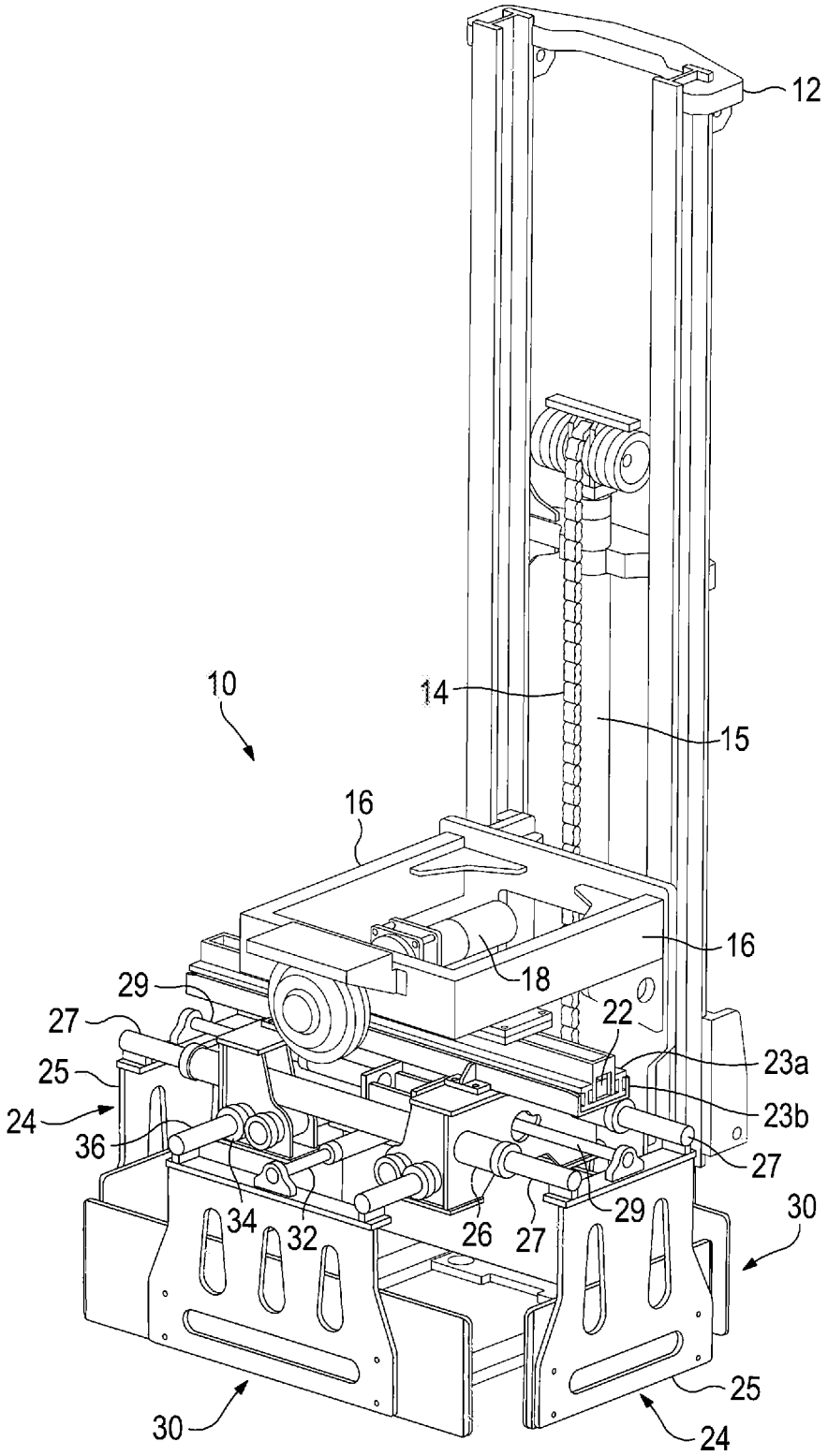
FIG. 1 is a three-dimensional view of an exemplary embodiment of a layer-picking load clamp assembly in accordance with the present invention, shown mounted on an exemplary lift truck mast in a laterally centralized position relative to the mast, and capable of bidirectional transverse side-shifting movement selectively toward either side of the mast.
Figure 2:
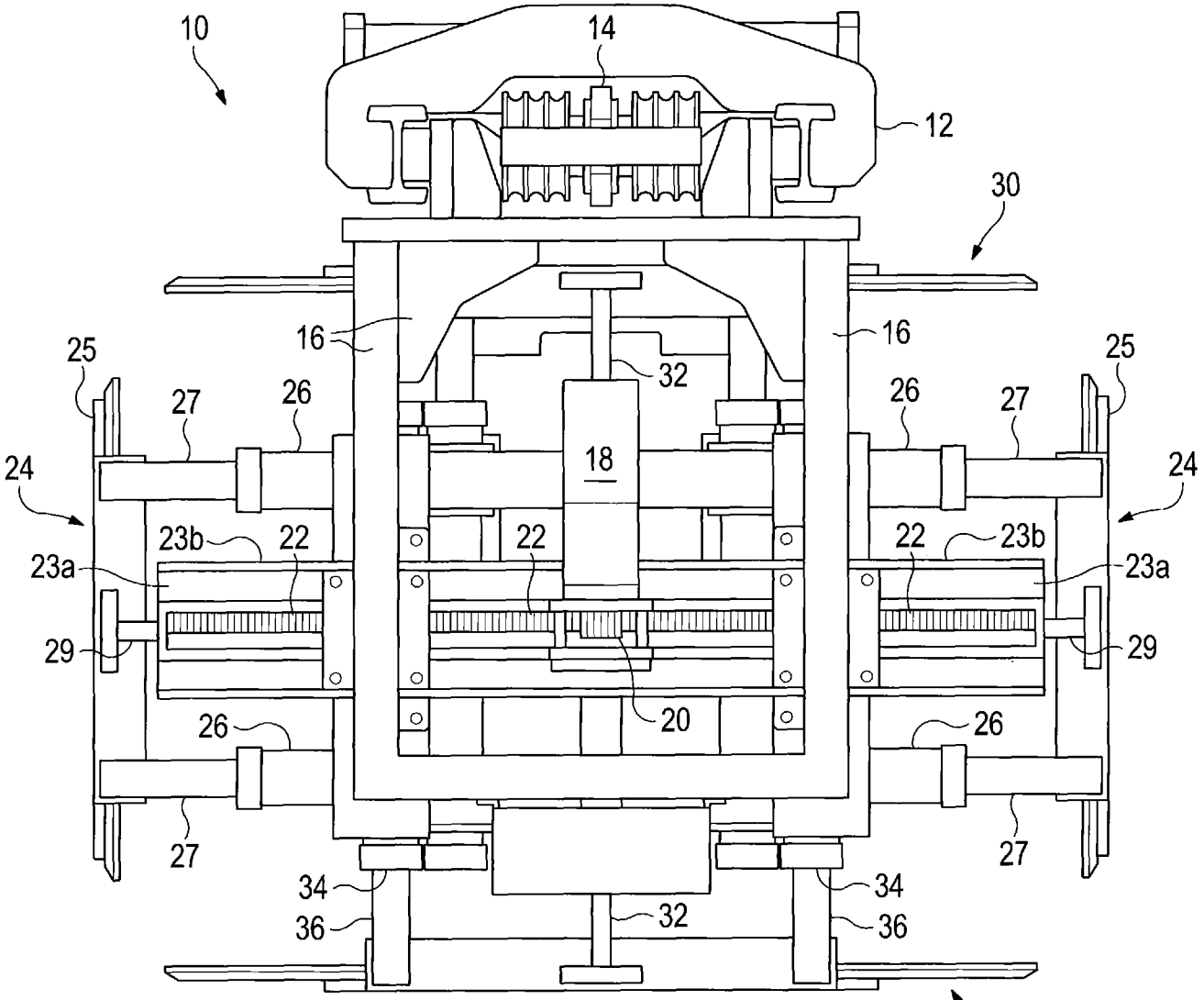
FIG. 2 is a top view of the exemplary embodiment of FIG. 1.

An exemplary layer-picking load clamp assembly, indicated generally as 10, is shown in FIGS. 1 and 2 as being optionally mounted on an exemplary load-lifting member 12, such as a mast assembly of an industrial lift truck, so as to be selectively liftable and lowerable along the mast assembly by one or more lifting chains such as 14, powered by any suitable type of conventional load lifting assembly such as one or more hydraulic cylinders 15 within the mast assembly.

The lifting chain 14 is connected to, and vertically movably supports, a forwardly-projecting load-lifting arm assembly 16 which may comprise a rectangular frame as shown, or any other suitable vertically movable load lifting structure. The load-lifting arm assembly 16 supports a bidirectional side-shifting assembly having a selectively reversible hydraulically driven rotary motor drive assembly 18 equipped with a selectively operable hydraulic brake. The motor drive assembly 18 is preferably capable of selectively bidirectionally driving or braking a conventional toothed rack and pinion gear assembly, shown schematically as 20, 22 in FIG. 2. Such rack and pinion assembly can selectively bidirectionally drive or brake one or more conventional elongate telescopically extensible toothed rack assemblies, shown schematically as 23*a* and 23*b* respectively, in a known matter so as to selectively telescopically retract or extend such rack assembly in either of two opposite side-shifting directions relative to the load-lifting member 12, as exemplified in FIGS. 3 and 4.

Vertically supported by the rack assembly 23*b*, and movable in unison therewith, is an exemplary layer-picking load clamping assembly generally indicated as 24 mountable transversely to the lift truck mast 12 as shown in FIGS. 1-4. The load clamping assembly 24 preferably has oppositely transversely-extending structural tubes such as 26 which slidably support selective opening and closing of downwardly depending clamp arms 25 in opposite directions. Such selective opening and closing of the clamping assembly 24 is enabled by load-supporting members 27, slidable within the tubes 26 and selectively movable by extensible and retractable opposed hydraulic piston rods 29 to selectively open and close the clamping assembly 24.

Figure 3:
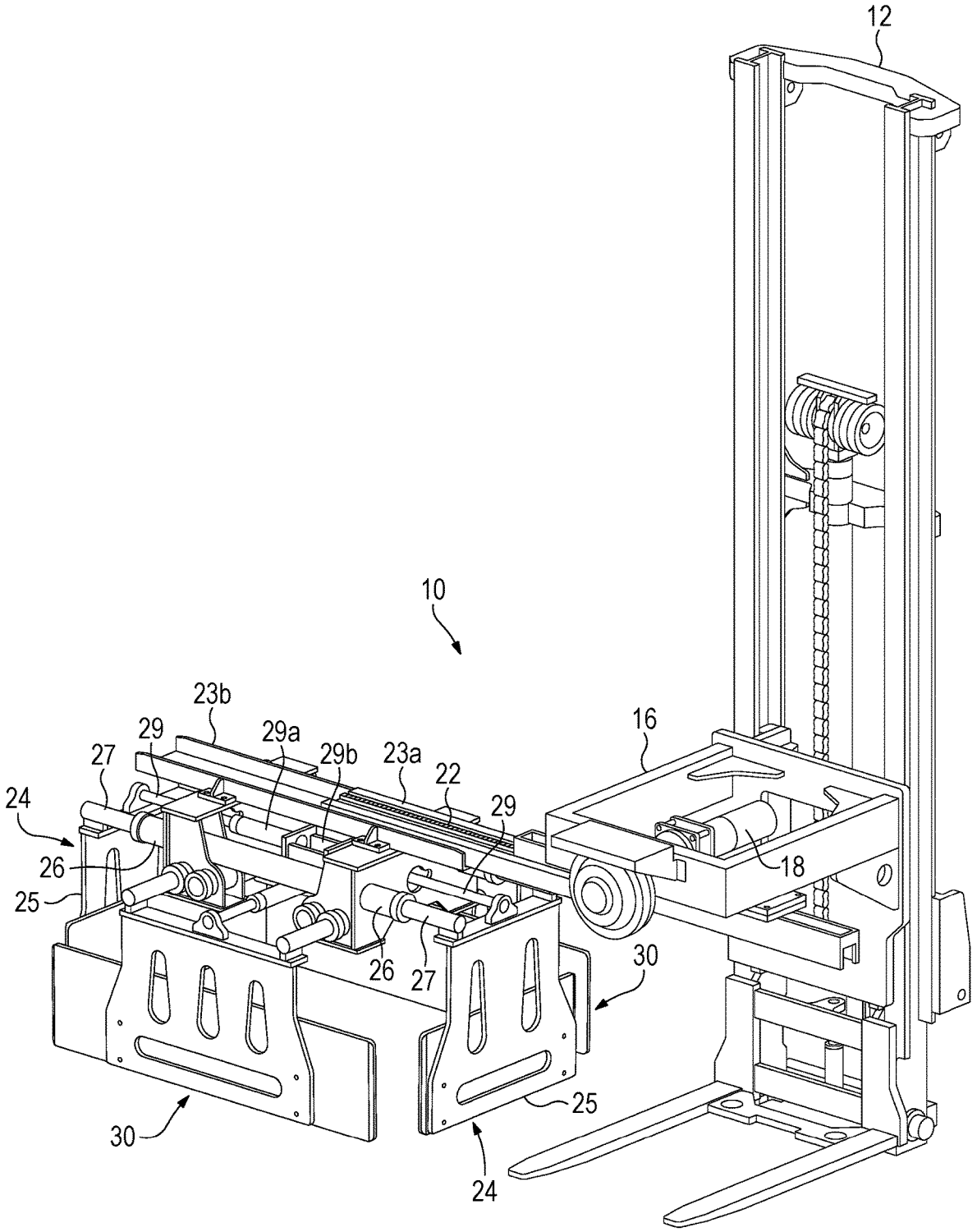
FIGS. 3 and 4 are three-dimensional views of the exemplary embodiment of FIGS. 1 and 2, shown in respective opposite transversely extended side-shifted positions relative to the centralized position exemplified in FIG. 1.
Figure 4:
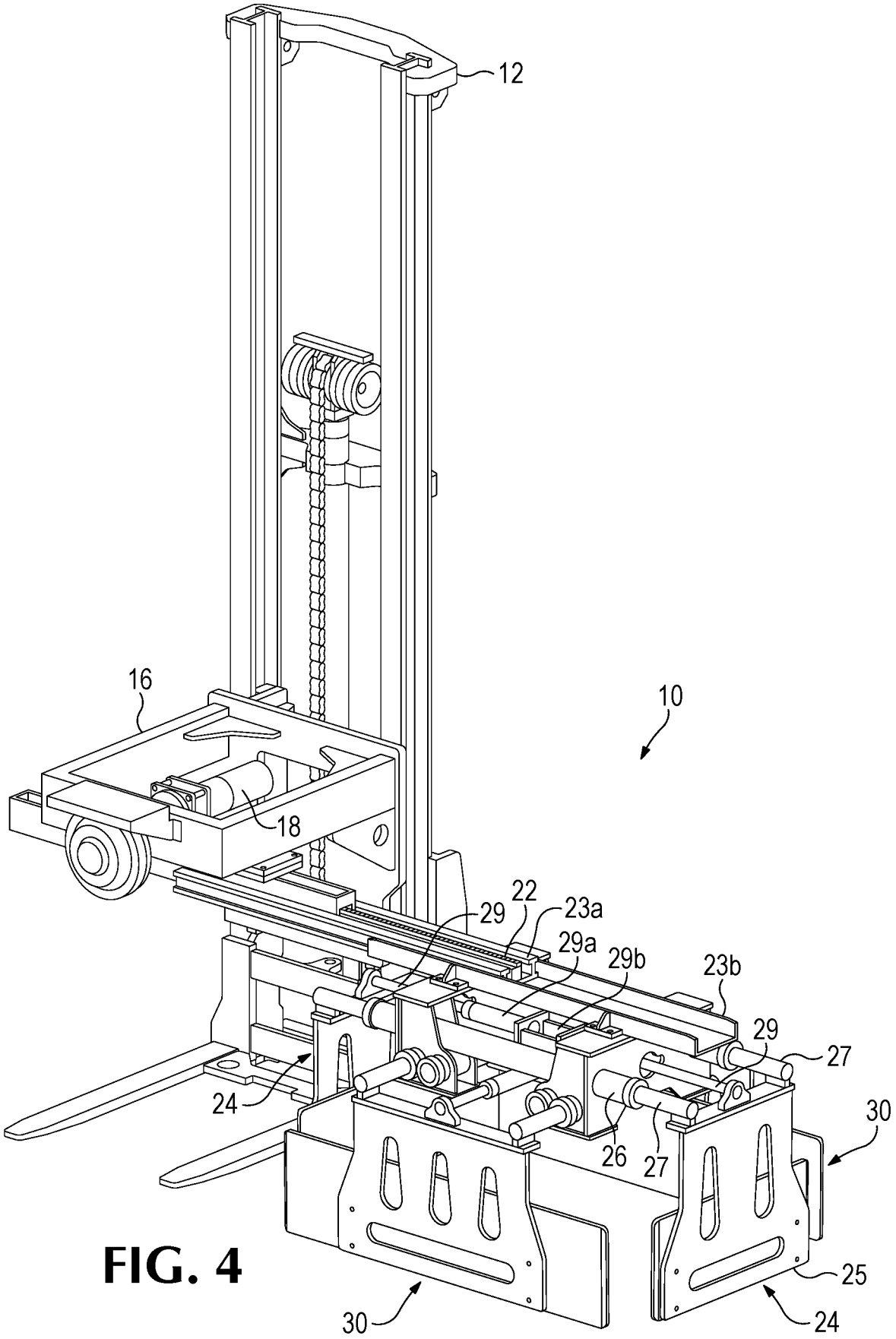

Optionally, hydraulic cylinders such as 29*a* shown in FIGS. 3 and 4 can control the opposed piston rods 29 selectively either together or separately so as to be able not only to properly clamp or unclamp loads, but also to further adjust the effective sideshifting range of the clamping assembly 24 if necessary to enable even more extensive bidirectional transverse positioning of the layer-picking structure.

Preferably, but not necessarily, mounted transversely to the foregoing load clamping assembly 24 is a separate load clamping assembly 30 for selectively engaging the front and rear sides of the load, transversely to the direction of engagement of the load clamping assembly 24. Such engagement can be controlled by separate hydraulic piston rods 32 which selectively extend or retract the clamping assembly 30. The separate clamping assembly 30 is preferably supported telescopically by structural tubes such as 34 and slidable rods such as 36 in a direction perpendicular to the previously described tubes 26.

Depending upon the transverse length dimensions of the loads to be handled, or other variables, the foregoing extensible rack assembly 23*a*, 23*b* may or may not require multiple telescopically extensible overlapping rack stages. However, if the expected transverse lengths of the loads to be handled, and/or the expected degree of transverse extension of the loads, are large enough to require one or more telescopic rack stages, each rack stage should preferably have a length which is substantially within the transverse width dimension of the lift truck or other support upon which the rack assembly is mounted, as exemplified in FIGS. 1 and 2. Such a limited rack stage length will preferably minimize the rack assembly's retracted length along the transverse side-shifting direction sufficiently to enable transport of smaller clamped loads through narrow spaces, while at the same time making it possible to provide enough overlapping telescopically extensible rack stages to enable camping of loads having larger transverse dimensions.

Conventional multi-stage telescopic hydraulic piston and cylinder designs are alternatively usable in the present invention in place of rack and pinion technology, although not as effectively because of more limited degrees of retraction of such piston and cylinder structures. However, all of the foregoing existing telescopic types of designs described herein can provide significant improvements relative to presently known layer-picking load handling techniques.

The terms and expressions which have been employed in the foregoing specification are used therein as terms of descriptive examples, and not of limitation, and there is no intention, in the use of such terms and expressions, of excluding equivalents of the features shown and described or portions thereof, it being recognized that the scope of the invention is defined and limited only by the claims which follow.

The invention claimed is:

1. A layer-picking assembly comprising:

(a) a forwardly-projecting load-lifting arm assembly;

(b) a forwardly-extending load-clamping assembly, capable of clamping a load and further capable of selectively moving said load forwardly relative to said forwardly-projecting load-lifting arm assembly, said load-clamping assembly including:

(i) a clamp having an upper frame section, (ii) at least four clamp arms having respective substantially vertically oriented gripping surfaces extending downwardly from and movably mounted to said upper frame section, (iii) said clamp arms being linearly movable with respect to said upper frame section in horizontally inward and outward directions so that said gripping surfaces retain substantially vertical orientations as said clamp arms move inward and outward, and (iv) each of said clamp arms being movably mounted to said upper frame section by at least one linear slide guide, and being moveable linearly inward and outward by at least one hydraulic cylinder oriented parallel to said slide guide; and (c) a bidirectional side-shifting assembly connecting said load-clamping assembly to said load-lifting arm assembly, said side-shifting assembly being capable of selectively bidirectionally side-shifting said load clamping assembly with respect to said load-lifting arm assembly straightly in opposite directions transversely beyond said load-lifting arm assembly without requiring forward extension of said load-clamping assembly relative to said load-lifting arm assembly, said side-shifting assembly including:

(1) a first toothed rack assembly fixedly attached to the upper frame section, (2) a second toothed rack assembly slidably received in the first toothed rack assembly, wherein the second toothed rack assembly is operably engaged with the first toothed rack assembly, (3) a pinion gear operably engaged with the second toothed rack assembly, and (4) a motor drive assembly bidirectionally driving the pinion gear.

2. The assembly of claim 1, wherein each of the at least one linear slide guide is received in at least one corresponding opening of the upper frame section.

3. The assembly of claim 1, wherein the upper frame section includes first and second spaced upper frame portions, the first toothed rack assembly being fixedly attached to the first and second upper frame portions.

4. The assembly of claim 3, wherein each of the first and second upper frame portions includes at least one corresponding opening for at least one linear slide guide.

* * * * *